US006056120A

United States Patent [19]

Hollingsworth

[11] Patent Number: 6,056,120

[45] Date of Patent: May 2, 2000

[54] LOLLIPOP DISPLAY DEVICE

[75] Inventor: Tom Hollingsworth, Rancho Palo Verdes, Calif.

[73] Assignee: Adams & Brooks, Inc., Los Angeles, Calif.

[21] Appl. No.: 09/113,307

[22] Filed: Jul. 10, 1998

[51] Int. Cl.[7] ..... A47F 1/04

[52] U.S. Cl. ..... 206/562; 211/70.1; 211/85.4; 248/174

[58] Field of Search ..... 211/70.1, 85.4; 248/174; 206/562

[56] References Cited

U.S. PATENT DOCUMENTS

| | | | |
|---|---|---|---|
| 726,252 | 4/1903 | Brown et al. . | |
| 1,054,487 | 2/1913 | Bagley | 211/70.1 |
| 1,117,824 | 11/1914 | Fleming | 248/174 |
| 1,647,154 | 11/1927 | Soybel . | |
| 1,966,734 | 7/1934 | Rosen . | |
| 2,000,359 | 5/1935 | Stein | 211/85.4 |
| 2,224,938 | 12/1940 | Steckler . | |
| 3,176,504 | 4/1965 | Shapiro . | |
| 4,310,095 | 1/1982 | Fontiladosa . | |
| 5,024,011 | 6/1991 | Collins | 248/174 |
| 5,373,939 | 12/1994 | Bloomgren . | |
| 5,411,141 | 5/1995 | Bounds . | |

*Primary Examiner*—Linda Johnson
*Attorney, Agent, or Firm*—Burns, Doane, Swecker & Mathis, L.L.P.

[57] ABSTRACT

A collapsible lollipop display device comprises first and second walls inclined obliquely upwardly toward one another, whereby respective upper edges thereof are arranged in parallel and hinged to one another, enabling the walls to be swung toward one another to a collapsed state, and away from one another to an unfolded state. Each of the walls includes a plurality of parallel channels, the channels of each wall being inclined downwardly in a direction away from the channels of the other wall. A row of lollipops is situated in the channels of each wall. When the device is in the collapsed (compact) state, and loaded with lollipops, the device can be wrapped in plastic shrink wrap for shipping. At a retail store, the device can be unwrapped and unfolded to serve as a display device for the lollipops.

4 Claims, 4 Drawing Sheets

LOLLIPOP DISPLAY DEVICE

BACKGROUND OF THE INVENTION

The invention relates to a lollipop display device and a method of erecting the display device.

Lollipop display devices are utilized in retail stores for displaying lollipops. The display device can be formed of a paper (e.g., cardboard) blank that is erected along fold lines. Holes are punched in the blank through which the sticks of the lollipops can be inserted.

Display devices of that type are disclosed, for example, in U.S. Pat. Nos. 1,647,154 and 1,966,734. Those display devices, once erected, present an outer housing having one or more rows of upper holes formed in an upper portion of the housing, and a panel disposed inside of the outer housing and possessing lower holes that are spaced below, and in vertical alignment with, respective ones of the upper holes. The stick of each lollipop is inserted downwardly through a respective pair of the upper and lower holes to be supported in a vertical manner, with the confection portion of the lollipop exposed at the top of the display device.

While such display devices are effective, they possess certain drawbacks. For example, the need to provide an inside panel positioned such that the holes thereof are aligned with upper holes of the outer housing increases the cost of the display and complicates the erection procedure. Also, the need to insert each lollipop stick through two spaced-apart holes makes the lollipop insertion procedure more difficult and time consuming.

Although it is possible to erect the display device and insert the lollipops at the store where the lollipops are to be sold, it is common for those operations to be performed by the lollipop supplier who then wraps the lollipop-containing display devices in plastic shrink wrap prior to shipping. It will be appreciated that the shipping space occupied by a multitude of such filled display devices is considerable, adding to the shipping costs.

Another type of display device is depicted in FIG. 1 wherein the confection parts 2 of the lollipops 4 are laid into large slots 6 of the display device, and the sticks 7 are inserted into holes 8 so as to be inclined relative to vertical. While such a display device may facilitate the insertion of the lollipops, the other drawbacks described above are still present.

SUMMARY OF THE INVENTION

The present invention relates to a lollipop display device comprising first and second walls inclined obliquely upwardly toward one another, whereby respective upper edges thereof are arranged in parallel adjacent one another. Each of the walls includes a plurality of parallel channels. The channels of each wall are inclined downwardly in a direction away from the channels of the other wall. The channels include upper inlet openings arranged along the upper edge of a respective one of the walls. A row of lollipops is situated in each of the walls, such that lollipop sticks of each row are inserted into respective ones of the channels, and confection parts of the lollipops are exposed along the upper edges.

Preferably, the upper and lower edges are interconnected to form a hinge enabling the walls to swing toward and away from one another.

The housing preferably includes a base which is hinged to lower edges of respective ones of the walls to define second and third hinges therewith. The base forms a fourth hinge arranged in parallel with the first, second and third hinges and spaced from the second and third hinges, whereby the base comprises a pair of foldable sections that fold together about the fourth hinge when the walls are swung toward one another and the fourth hinge approaches the first hinge.

The invention also pertains to a method of packaging a lollipop display device. The display device comprises first and second walls having respective upper edges hinged together to enable the first and second walls to be swung toward one another to a collapsed shipping state, and away from one another to an unfolded display state. Each of the walls includes a plurality of parallel channels. The channels include upper inlet ends arranged along the upper edge of a respective one of the walls. The method comprises the steps of:

A. loading rows of lollipops into respective ones of the walls by inserting lollipop sticks into respective ones of the channels with confection parts of the lollipops exposed along the upper edges; and B. applying a plastic shrink wrap around the lollipops and the display device, with the walls disposed in the collapsed shipping state.

BRIEF DESCRIPTION OF THE DRAWING

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
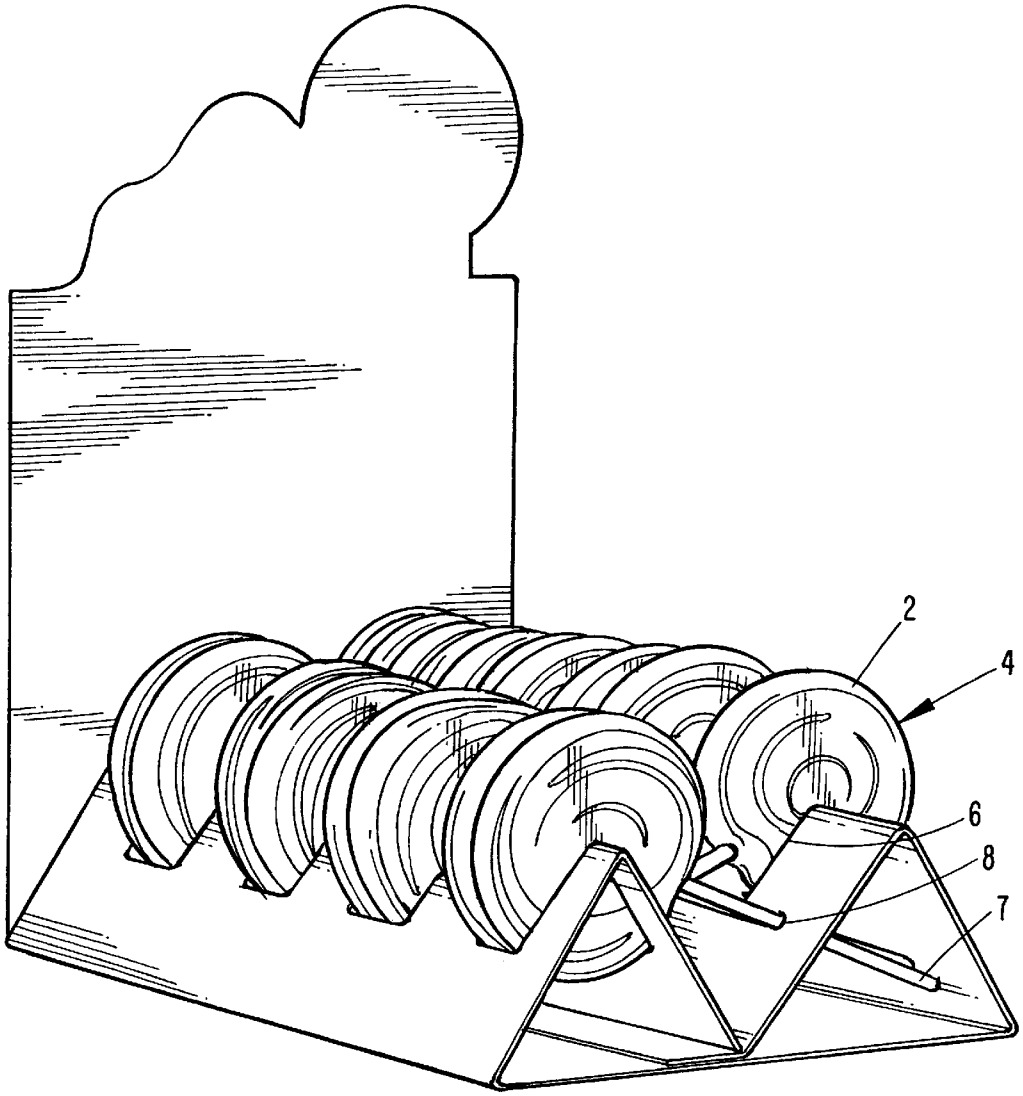
FIG. 1 PRIOR ART
FIG. 1 is a top perspective view of a prior art lollipop display member.
Figure 2:
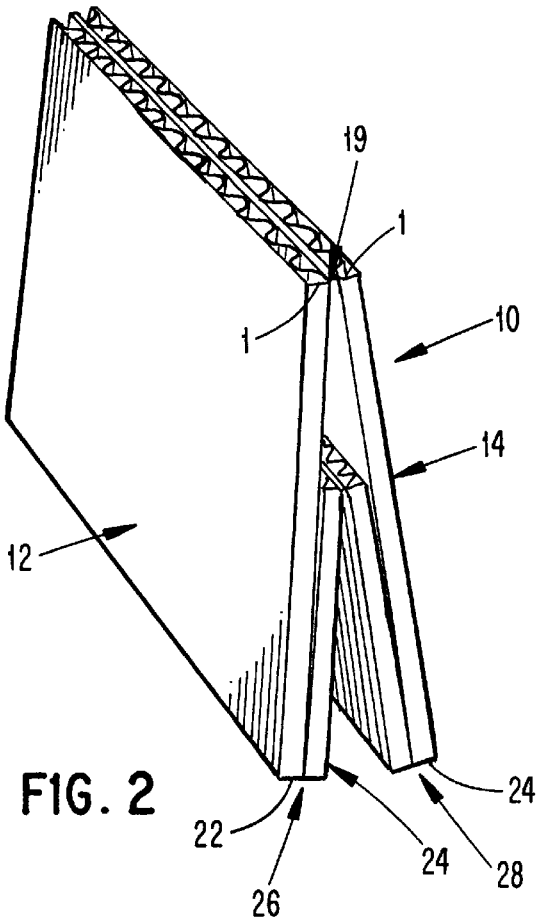
FIG. 2 is a top perspective view of a lollipop display device according to the present invention in a collapsed state, and without lollipops loaded therein.
Figure 3:
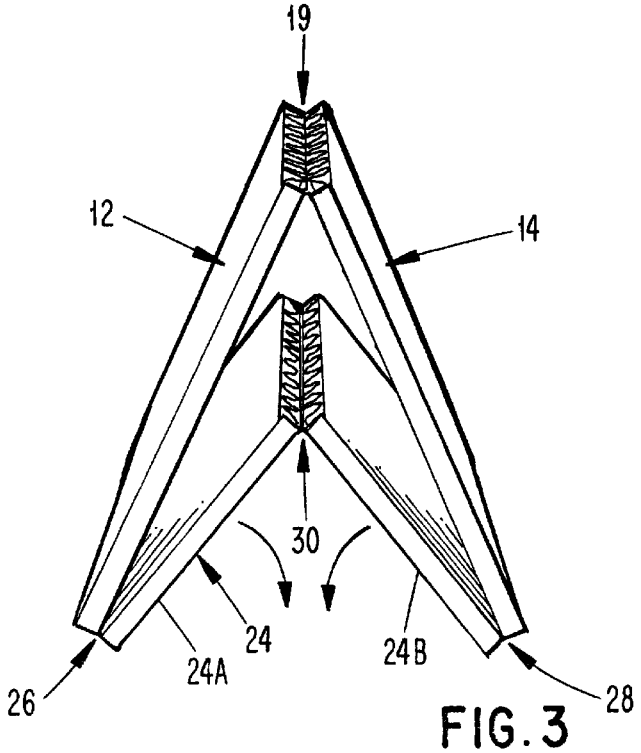
FIG. 3 is a view similar to FIG. 1 after the display device has been partially unfolded.

A lollipop display device 10 according to the present invention comprises first and second walls 12, 14 hinged together at their respective upper edges 16, 18 to define an upper hinge 19, with respective lower edges 20, 22 of the walls being hinged to a base 24 to define second and third hinges 26, 28. The base 24 includes a pair of segments 24A, 24B that are hinged together at a location between the lower edges 20, 22 to form a fourth hinge 30. It will be appreciated that the structure can be collapsed to a compact state by swinging the walls 12, 14 toward one another about the first hinge 19 while folding the base about the remaining hinges 26, 28, 30, such that the fourth hinge 30 approaches the first hinge 19.

Figure 7:
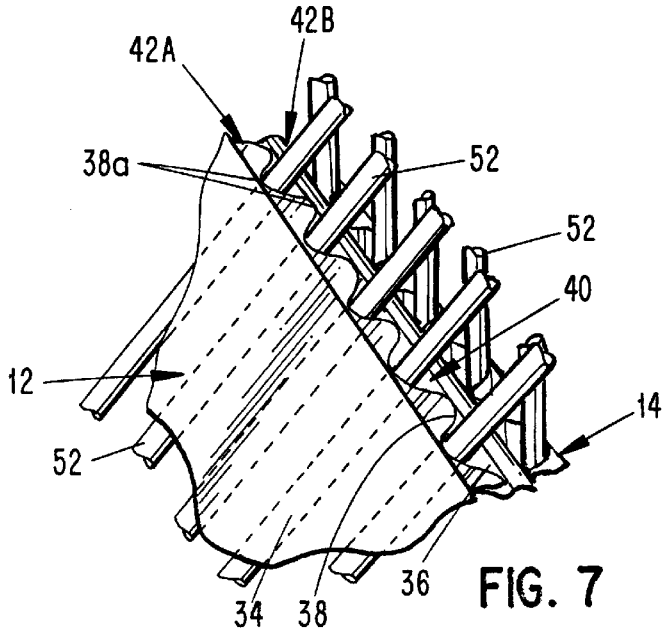
FIG. 7 is an enlarged, fragmentary view of a top edge of the display device depicted in FIG. 6.

The walls and base can be formed of any suitable material, such as plastic or paper, but preferably are formed of a corrugated cardboard strip which is bent to form the hinges 19, 26, 28 and joined together by tape at one of the hinges, e.g., the fourth hinge 30. With reference to FIG. 7, the strip comprises outer and inner paper sheets 34, 36 spaced apart to form a space in which a corrugated sheet 38 is positioned. The sheet 38 is wave-shaped as can be seen in FIG. 7, with peaks 38*a* of the sheet alternatingly engaging in the inner and outer sheets 34, 36. The outer sheet 34 and corrugated sheet 38 are cut at the first, second and third hinges 19, 26, 28 to form those hinges, and the inner sheet and corrugated sheet 38 are cut at the fourth hinge 30 to define that hinge. Portions of the outer sheet 34 disposed on the base sections 24A, 24B, respectively could be joined together by adhesive tape, whereby the walls 12, 14 and base 24 together form an endless, integral structure.

Figure 4:
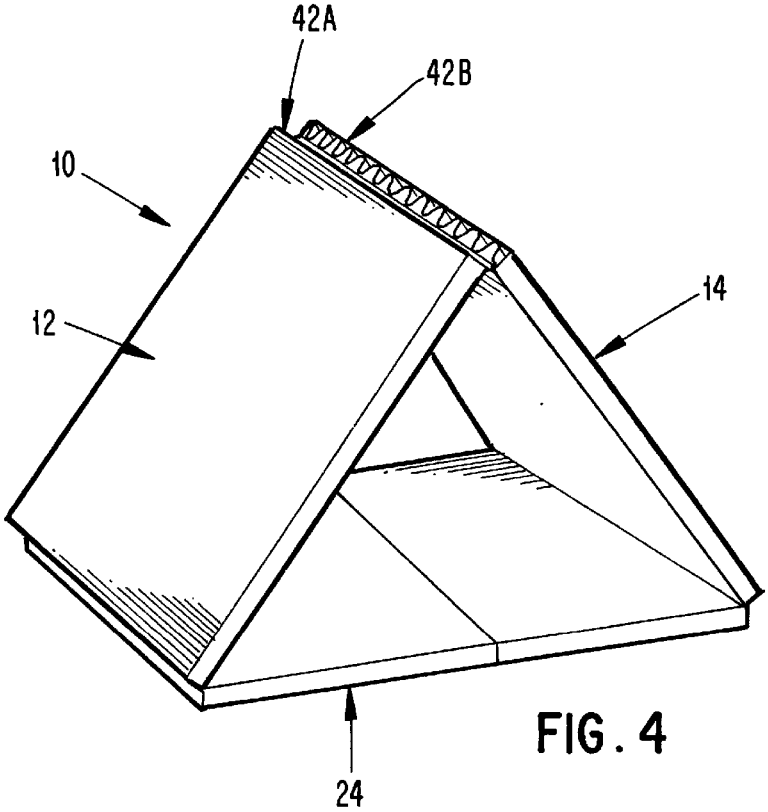
FIG. 4 is a view similar to FIG. 3 after the display device has been completely unfolded.

The corrugated sheet 38 forms parallel channels 40 in each of the walls 12, 14, and the sheet 38 is arranged such that each of the channels has an upper opening thereof disposed at the first hinge 19. That is, there is a row 42A of openings 42 extending along the upper edge 16 of the wall 12, and a row 42B of openings 42 extending along the upper edge 18 of the wall 14. Each channel 40 extend uninterruptedly from an upper edge 16 (or 18) of the respective wall to a lower edge 20 (or 22) thereof, as can be seen in FIG. 4.

With the walls 12, 14 and base 24 in an unfolded, erected state (see FIG. 4), the channels 40 of each wall 12, 14 extend obliquely downwardly and away from the channels of the other wall.

Figure 5:
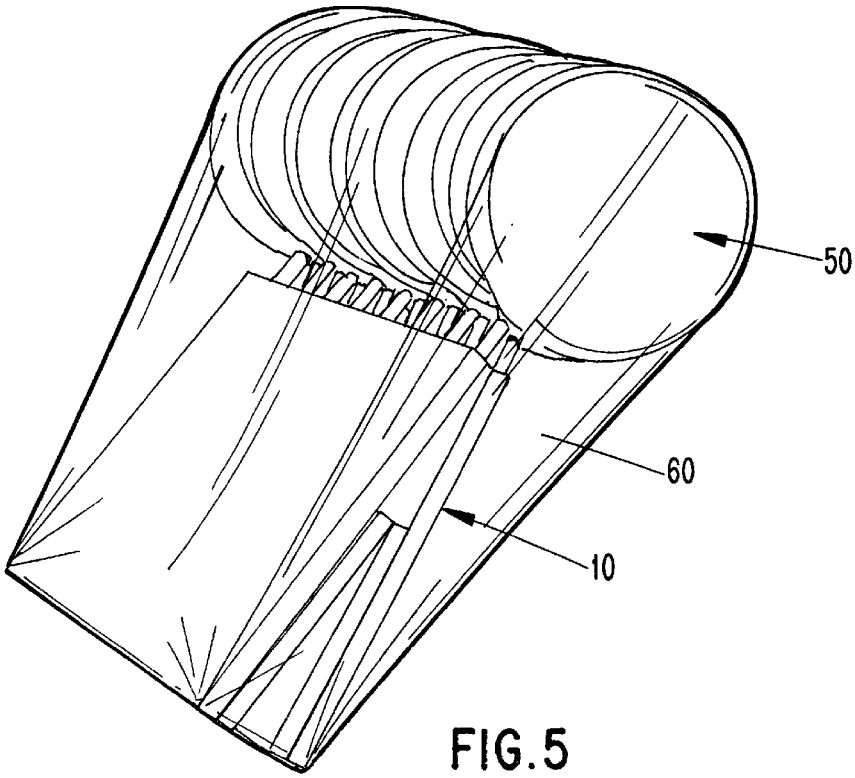
FIG. 5 is a perspective view of the display device in a collapsed state, loaded with lollipops, and wrapped with a plastic shrink wrap.
Figure 6:
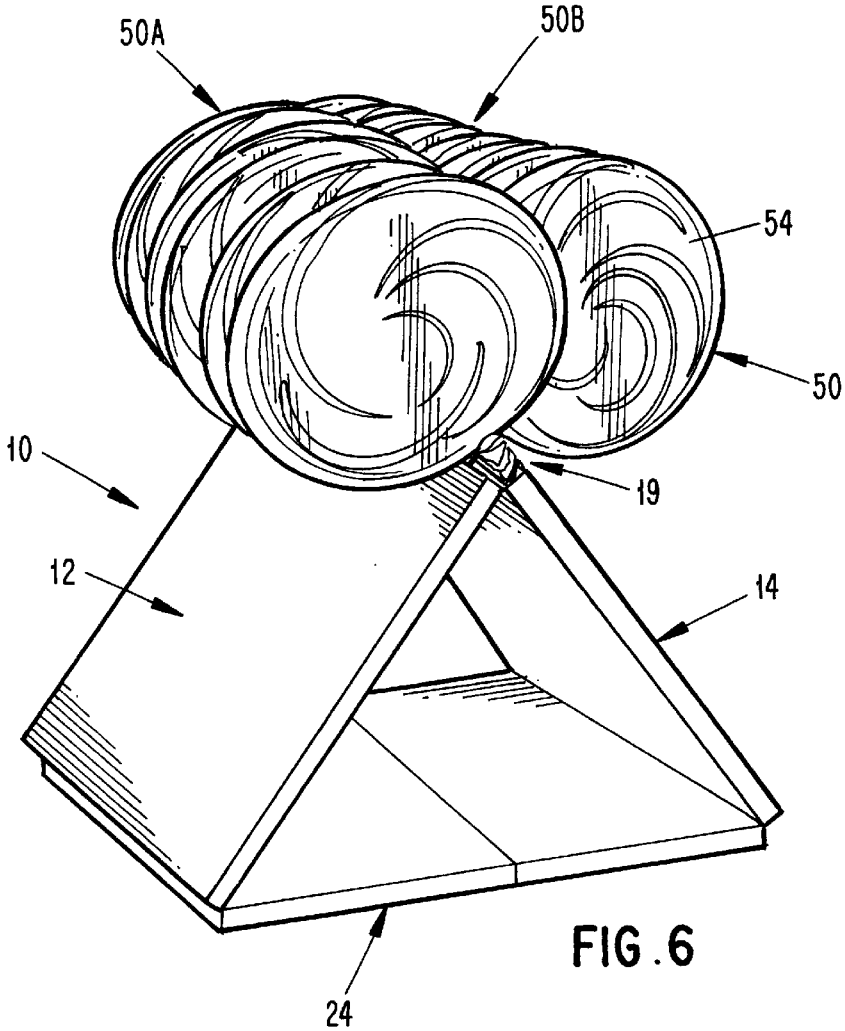
FIG. 6 is a view similar to FIG. 4, with lollipops loaded into the display device.

To load the device with lollipops 50, the sticks 52 of the lollipops are inserted downwardly into respective ones of the channels 40 through the upper openings thereof, thereby forming two rows 50A, 50B of lollipops (see FIG. 6). The confection parts 54 of the lollipops 50 remain exposed above the first hinge 19. The lollipops are loaded such that the confection parts 54 of each row are staggered and overlapped with respect to the confection parts 54 of the other row. By "staggered" is meant that the lollipops of each row are disposed in respective planes which alternate with vertical planes in which the lollipops of the other row are disposed. By "overlapped" is meant that a vertical plane containing both of the first and fourth hinges 19 and 30 intersects all of the lollipops in both rows 50A, 50B. The compactness achieved by this staggered and overlapping relationship is most beneficial when the device is in a collapsed shipping state as shown in FIG. 5 (to maximize the compactness), but is also advantageous when the device is in an unfolded display state.

In practice, the display device 10 is loaded with lollipops 50 by inserting the sticks 52 into respective ones of the channels 40, whereby there are formed two rows 50A, 50B of lollipops, with the lollipops of each row arranged in staggered, overlapped relationship with respect to the lollipops of the other row.

The act of inserting the sticks is simplified, since it is only necessary to align each stick with one hole, i.e., the opening of the respective channel 40. It is not necessary to align the stick with a second hole after passing it through one hole, as in the prior art. The display device itself is simplified since it is not necessary to install a panel possessing such second holes.

The loading could be performed by personnel of a store where the lollipops are to be displayed and sold. More likely, however, the loading will be performed by the lollipop supplier, and then the loaded display device would be packaged and shipped to the store.

The packaging would be performed by encasing the entire unit comprised of the display device 10 and lollipops in plastic shrink wrap 60, with the device in a collapsed state. That unit is very compact, occupying a relatively small shipping space to reduce shipping costs. Once at the store, the store personnel need only remove the shrink wrap and unfold the device whereby the device automatically assumes the configuration shown in FIG. 6. No special skills are required.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A lollipop display device comprising first and second walls inclined obliquely upwardly toward one another, whereby respective upper edges thereof are arranged in parallel adjacent one another; each of the walls including a plurality of parallel channels; the channels of each wall inclined downwardly in a direction away from the channels of the other wall; the channels including upper inlet openings arranged along the upper edge of a respective one of the walls; a row of lollipops situated in each of the walls, such that lollipop sticks of each row are inserted into respective ones of the channels, and confection parts of the lollipops are exposed along the upper edges; each of the walls including inner and outer parallel sheets spaced apart to define a space therebetween, and a corrugated sheet situated in the space, the corrugated sheet being wave-shaped, with peaks of the waves alternatingly contacting the inner and outer sheets; the inner and outer sheets together with the corrugated sheet forming the channels; the channels extending uninterruptedly from the upper edge of the wall to a lower edge of the wall.

2. The lollipop display device according to claim 1 wherein confection parts of each row are staggered and overlapped with respect to confection parts of the other row.

3. The lollipop display device according to claim 2 wherein the upper and lower edges are interconnected to form a hinge enabling the walls to swing toward and away from one another.

4. The lollipop display device according to claim 3 wherein the hinge constitutes a first hinge, the housing including a base hinged to lower edges of respective ones of the walls to define second and third hinges therewith, the base forming a fourth hinge arranged in parallel with the first, second, and third hinges and spaced from the second and third hinges, whereby the base comprises a pair of foldable sections that fold together about the fourth hinge when the walls are swung toward one another and the fourth hinge approaches the first hinge.

* * * * *